United States Patent [19]

Herwig et al.

[11] Patent Number: 5,069,580

[45] Date of Patent: Dec. 3, 1991

[54] SUBSEA PAYLOAD INSTALLATION SYSTEM

[75] Inventors: Harry A. Herwig, Woodlands; Doyle D. Hickok, Houston, both of Tex.

[73] Assignee: FSSL, Inc., Sugarland, Tex.

[21] Appl. No.: 588,070

[22] Filed: Sep. 25, 1990

[51] Int. Cl.[5] ..... E02D 23/08; E02B 17/02

[52] U.S. Cl. ..... 405/191; 405/188; 405/203; 405/209; 405/224

[58] Field of Search ..... 405/185, 188, 190, 191, 405/158, 171, 172, 195, 203-210, 224, 192; 166/338, 341, 342, 344

[56] References Cited

U.S. PATENT DOCUMENTS

| | | | |
|---|---|---|---|
| 3,516,489 | 6/1970 | Jergins | 166/367 X |
| 3,638,720 | 2/1972 | Thomas | 166/357 X |
| 3,777,688 | 12/1973 | Melhose | 166/342 X |
| 3,795,114 | 3/1974 | De Cremiers et al. | 405/191 |
| 3,841,106 | 10/1974 | Blumberg | 405/172 |
| 3,943,725 | 3/1976 | Pennock | 166/341 X |
| 3,987,741 | 10/1976 | Tryon | 114/51 X |
| 4,010,619 | 3/1977 | Hightower et al. | 405/191 |
| 4,095,649 | 6/1978 | Chateau et al. | 405/185 X |
| 4,286,896 | 9/1981 | Melitz et al. | 405/185 |
| 4,391,332 | 7/1983 | Fayren | 166/350 |
| 4,484,838 | 11/1984 | Stevens | 405/191 |
| 4,541,754 | 9/1985 | Castel et al. | 405/168 |
| 4,618,285 | 10/1986 | Ahlstone | 405/191 |
| 4,673,313 | 6/1987 | Baugh et al. | 405/195 |
| 4,711,601 | 12/1987 | Grosman | 405/204 |
| 4,721,055 | 1/1988 | Pado | 114/331 |
| 4,740,110 | 4/1988 | Saffrhan | 405/225 |
| 4,744,698 | 5/1988 | Dallimer et al. | 405/226 |
| 4,784,525 | 11/1988 | Francois | 405/191 |
| 4,828,430 | 5/1989 | van der Heyden | 405/209 |

*Primary Examiner*—Dennis L. Taylor
*Assistant Examiner*—John Ricci
*Attorney, Agent, or Firm*—Browning, Bushman, Anderson & Brookhart

[57] ABSTRACT

Improved methods and apparatus are provided for landing and securing a payload to a subsea assembly, such as a hydrocarbon recovery assembly, utilizing a surface vessel and a subsea ROV. The payload is suspended from a submersible payload package, and the package and payload are lowered subsea by a vessel cable. Guide cables extending from the package may be secured to the subsea assembly, and a floatation device thereafter activated to render the package positively buoyant, thereby making the guide cables taunt and relaxing the vessel cable to de-couple the package and payload from the surface vessel. The guide cables are then used to lower the payload from the package onto the assembly, and the payload secured to the assembly with the ROV. The floatation device is subsequently deactivated such that the pacakage is no longer positively buoyant, thereby re-coupling the package to the surface vessel.

21 Claims, 3 Drawing Sheets

SUBSEA PAYLOAD INSTALLATION SYSTEM

BACKGROUND OF THE INVENTION

1. Field of the Invention

The present invention is directed to a techniques for the installation of a payload in a remote location and, more particularly, to techniques involving the installation of a subsea payload using a surface support vessel and a remotely operated vehicle.

2. Description of the Background

A significant amount of effort has been expended during the past 20 years to further develop systems which will facilitate the economic recovery of hydrocarbon from offshore installations. Exemplary prior art offshore drilling and production technology, particularly with respect to "completing" a well to produce hydrocarbons, is disclosed in U.S. Pat. Nos. 3,516,489, 3,638,720, and 3,987,741. In a typical offshore wells is drilled from either a ship or an offshore platform. A separate subsea production facility may be installed after drilling. One type of subsea production installation utilizes hollow structural columns which are buoyed to impart a tensional force on the columns, as disclosed in U.S. Pat. No. 4,391,332. U.S. Pat. Nos. 4,673,313, 4,740,110, and 4,744,698 disclose prior art technology with respect to marine production risers, platform grouting techniques, and marine silos.

Convention techniques for the installation of subsea equipment, commonly referred to as a subsea payload, utilize a surface support vessel or ship, in conjunction with a remotely operated vehicle or ROV. Traditional installation techniques employ a ship with dynamic positioning devices which compensate for turbulence, heave, roll, pitch, and/or drift of the ship caused by surface or near surface conditions. Such dynamic positioning or compensation devices maintain the ship over the subsea installation site, and minimize the effects of vessel motion induced on the subsea payload during installation. Such compensation devices are, however, very expensive, and surface vessels with such compensation systems are of a very limited availability.

Most subsea payloads are installed with the assistance of an underwater ROV. A great deal of technology has been developed to increase the capability of ROVs, although ROVs themselves are very expensive. A garaged-type ROV is disclosed in U.S. Pat. No. 4,010,619. Smaller and less expensive "all electric" ROVs have also been used to assist in subsea payload installation, and the latter ROV typically is not provided with a subsea garage. U.S. Pat. No. 4,721,055 discloses a technique for increasing the payload capacity of an ROV by utilizing a "clump weight" in conjunction with conventional ROV buoyancy to increase the lifting capacity of the ROV. The ROV as disclosed in the '055 patent may be operated in a positive buoyancy mode, a free swimming mode, or a towed mode.

Various specialized techniques and systems have been devised to facilitate installation of a particular type of subsea payload. U.S. Pat. Nos. 4,484,838, 4,618,285, and 4,784,525 each disclose especially designed employment systems to address an installation problem for a substantially single purpose or a single type of payload. The '285 patent discloses the use of a gas or other buoyant material with in a centralizer body to allow a payload to be installed from below up to the subsea assembly, while most subsea payloads are lowered from above down to the subsea assembly. Each of these patents disclose techniques which are not economically practical for the installation of most subsea payloads. Accordingly, the cost of installing subsea payloads remains high. Surface vessels with compensation devices are frequently unavailable, and are extremely expensive and not justified for most payload installations. As a result, scheduling of the installation of a subsea payload is frequently delayed until periods when the sea conditions substantially minimize the movement of the surface vessel. Even under these conditions, however, substantial time is required to install the payload, and accordingly the ROV used in the installation technique itself is expensive, with a good deal of the difficulty and time being attributable to the minimal although ever-present movement of the ship.

The disadvantages of the prior art are overcome by the present invention, and improved subsea payload installation techniques and methods are hereinafter disclosed for substantially minimizing the difficulty and expense associated with installing a payload on a subsea assembly.

SUMMARY OF THE INVENTION

The system of the present invention employs a conventional surface vessel with a crane and cable for lowering an ROV into the water. The surface vessel need not contain elaborate and expensive dynamic positioning systems, since the payload when installed unto the subsea assembly is effectively decoupled from the ship. Extensive vessel excursions during installation thus do not adversely affect the ability of the ROV to safely and reliably land and secure the payload. The concept of the present invention may be used with various ROVs, including garaged ROVs or all electric ROVs.

For a system employing a garaged ROV, the subsea garage and ROV may be lowered at the installation site using a crane and a conventional cable, and preferably a single cable to minimize complications arising from the use of multiple parallel cables. The payload is typically supported from another cable below the ROV garage, with guide lines extending downward from the payload storage package. Once the payload storage package is near the installation site, the ROV may be de-garaged and used to attach the lower ends of the guide lines to the subsea assembly at locations spaced circumferentially about the installation site. The inflation device associated with the payload storage package is then activated to generate a positive buoyancy, thereby substantially fixing the position of the payload storage package with respect to the subsea assembly and decoupling the storage package from the surface vessel and the ROV garage. Once decoupled, the payload may be lowered from its package onto the installation site utilizing the ROV, with the horizontal payload movement being substantially controlled by the guide wires. Once the payload has been landed and connected to the subsea assembly, the payload storage package may be deballast, thereby re-coupling this package to the ship. The guide wires may then be disconnected by the ROV, and the ROV again garaged. The ROV garage and payload package may then be winched back to the surface vessel.

It is an object of the present invention to provide improved methods and techniques for installing a subsea payload utilizing a relatively simple surface support vessel.

It is a further object of the present invention to provide practical techniques for the low-cost installation of a subsea payload in various weather conditions.

It is a further object of this invention to provide an improved system for installing a subsea payload utilizing a surface vessel which does not require expensive and complicated dynamic positioning devices.

It is a feature of the present invention that the subsea installation technique may utilize various types of existing ROVs and is not limited to any type of ROV.

It is a further feature of the invention that the subsea payload is effectively decoupled from the surface vessel prior to installation and without utilizing sophisticated decoupling equipment.

It is yet another feature of the invention that the installation technique substantially minimizes ROV intervention and therefore decreases the effective cost of using ROVs for a particular subsea job.

It is an advantage of the present invention that the techniques may be used for installing various subsea payloads for different subsea assemblies and various subsea applications.

Yet another advantage of the invention is that proven and existing equipment and components may be utilized to install a subsea payload, thereby minimizing new equipment costs.

These and further objects, features and advantages of the present invention will become apparent from the following detailed description, wherein reference is made to the figures in the accompanying drawings.

DESCRIPTION OF THE PREFERRED EMBODIMENTS

The present invention provides a relatively in expensive yet reliable technique for decoupling a subsea payload from a surface vessel, thereby substantially minimizing the difficulty associated with landing and securing the payload to a subsea assembly. Those skilled in the art appreciate that the techniques of the present invention are particularly well suited for installing a payload in a subsea hydrocarbon production facility. Individual components used according to this system are commercially available from a variety of sources, and thus are not discussed in detail in this application. The versatility of the invention, as well as its immediate commercial capability, are thus significant features of the invention.

Figure 1:
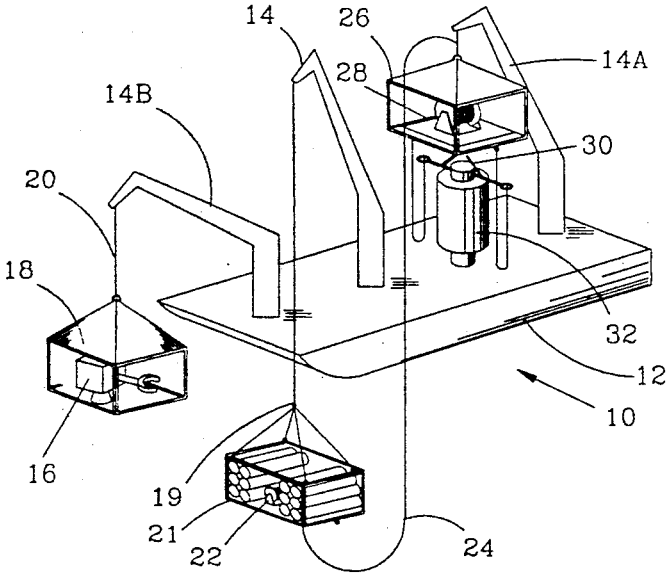
FIG. 1 is a simplified pictorial view of a surface vessel, a submerged ROV garage, and a payload package assembly on the surface vessel.

FIG. 1 depicts a system 10 for landing and installing a subsea payload, which may take various forms. The present invention utilizes a standard surface vessel or ship 12, which need not include dynamic compensation systems of the type conventionally used when installing subsea payloads. The vessel 12 does include one or more conventional cranes 14 for lowering the payload and a conventional ROV into the water. For the embodiment discussed subsequently, the ROV is provided with a subsea garage of the type well known in the art, although a less expensive ROV as discussed subsequently may also be utilized.

FIG. 1 generally depicts an ROV 16 housed within a garage 18 which has been lowered subsea from a cable 20. The garage and ROV may or may not be partially ballast and cable 20 provides both the desired support between the vessel 12 and the garage 18, as well as a communication link between the vessel and the ROV. Attached to the cable 19 is a payload control assembly 21 which includes a powered winch 22 for selectively winding and unwinding cable 24 which is secured to a conventional payload package 26, which as shown in FIG. 1 is still stored on the vessel 12. The package 26 includes a second powered winch 28 for outputting cable 30, with a payload 32 being attached to the opposite end of cable 30. The package 26 may thus be used to install various payloads, and the preferred vessel, package, and ROV will depend generally on the size of the payload.

Figure 3:
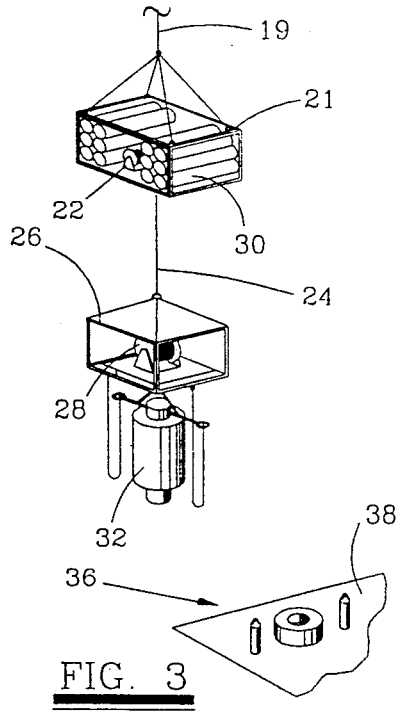
FIG. 3 is a pictorial view of the submerged ROV garage and payload package assembly, with the payload package assembly lowered near the intended installation site.
Figure 2:
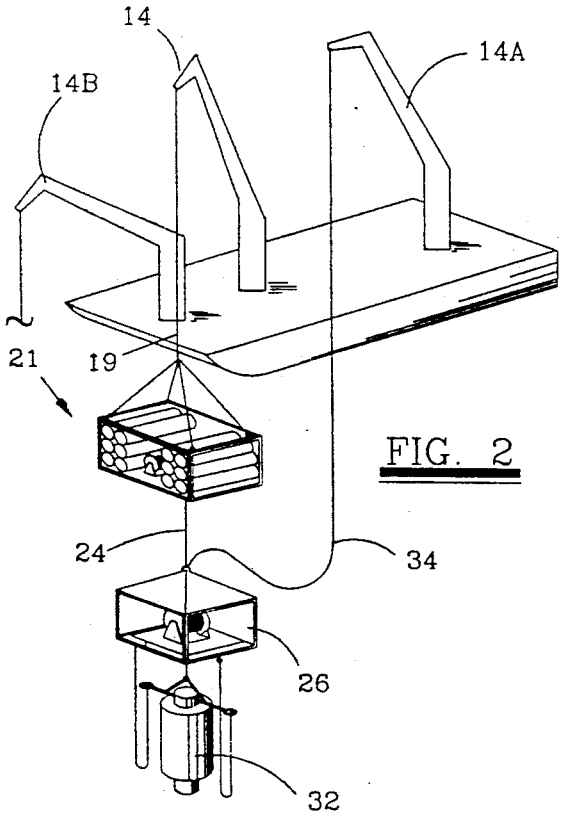
FIG. 2 is a simplified pictorial view of the submerged ROV garage shown in FIG. 1, with the payload package assembly supported from the garage by a cable.
Figure 4:
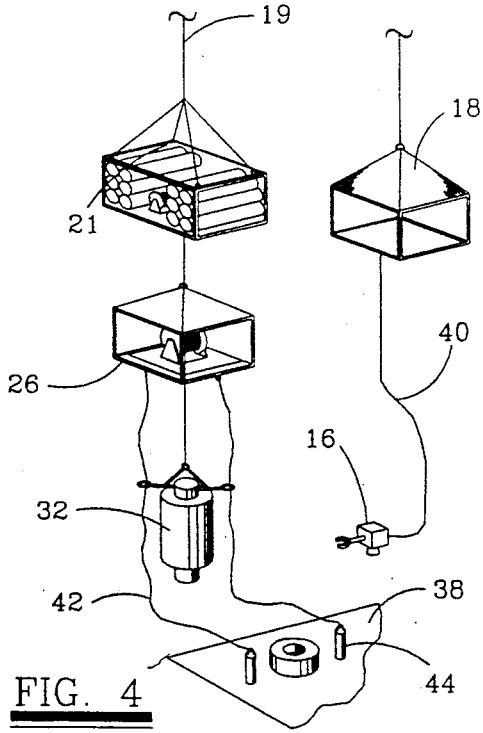
FIG. 4 is a pictorial view of the ROV moved from and tethered to the ROV garage, with guide wires from the payload package assembly secured to the subsea installation cite.

FIG. 2 illustrates that crane 14A has lowered the package 26 and payload 32 attached thereto into the water using cable 34, with cable 24 simultaneously being wound up by winch 22, so that package 26 and payload 32 are now supported from cable 24 and payload control assembly 21, as shown. The cable 34 may then be disconnected and cable 20 unwound until the garaged ROV and closely adjacent package 26 and payload 32 are reasonably near yet positioned above the installation site, e.g., approximately 20 meters above the installation site 36 on the subsea assembly 38. At this stage, winch 22 may be activated to unwind cable 24 and thereby lower the package 26 and payload 32 to a position closer to and yet safely above the installation site, e.g., from 5 to 10 meters above installation site 36, taking into account the movement of the package and payload with respect to the installation site in response to movement of the vessel 12. If desired, the winch 28 may be briefly activated to unwind cable 30 and slightly lower the payload 32 with respect to package 26, so that the system will be as generally shown in FIG. 3.

During the next operation, the ROV 16 may be removed from the garage 18, with power and communication between the garage and the ROV controlled by a conventional tether line 40. A plurality, and typically either 2 or 4, guide cables 42 may each be secured at one end to the package 26, either by the ROV 16 or by securing these guide cables to the package prior to lowering the package subsea and looping the cables as shown in FIG. 3. The other end of each of the cables may now be disconnected from the package 26 by the ROV, and dropped to free-fall by gravity. The lower end of each cable 42 may then be secured to a conventional hook or eyelet 44, or other securing device positioned circumferentially about the installation site 36. At this stage, the package 26 and the payload 32 are still coupled or effectively connected mechanically to the vessel, so that movement of the vessel with respect to the stationary subsea assembly 38 in any direction may cause movement of the package 26 and payload 32, although this movement is not harmful and will be taken up by the slack in the cables 42.

Figure 5:
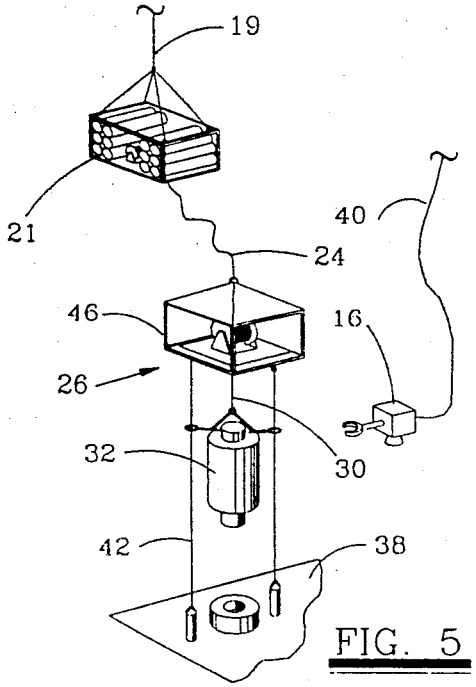
FIG. 5 illustrates the payload package assembly shown in FIG. 4 decoupled from the ROV garage and surface vessel, with the ROV utilized to land the payload at the desired location on the subsea assembly.

FIG. 5 illustrates that the floatation 46 on the package 26 has been activated to positively ballast the package 26 and thus the payload 32 connected thereto by cable 30. It should be understood that, prior to activating the floatation device 46, the package will likely not be located above the installation site 32 due to movement or exclusion of the vessel 12. Once the floatation device is activated as shown in FIG. 5, the guide lines 42 become taunt and cable 24 becomes slack, since both the package 26 and the payload 32 are now effectively de-coupled from the vessel 12 and coupled to the subsea assembly 38. As this stage, the package may now be centered vertically directly above the installation site 36, e.g. spaced less than one foot horizontally from site 36, due to the buoyancy and the action of the guide lines.

The floatation device 46 may be of various types, although it is a significant feature of this invention that the floatation device be of the type which can be activated to make the package 26 positively buoyant in the water, and deactivated such that the submerged package 26 again becomes heavier than water. A suitable floatation device comprises an elastic bladder and compressed gas tanks, so that ROV 16 or a remotely activated control valve operated at the surface may be used to open a valve (not shown) between the tank and the bladder, thereby inflating the bladder to make the package 26 positively buoyant. As explained subsequently, the ROV or operator may subsequently open another valve to allow the gas in the bladder to escape, thereby rendering the package 26 again heavier than water. Preferably one or more check valves may be used to prevent water from entering the bladder, so that after the bladder is deflated, the ROV or operator may, if necessary, subsequently reinflate then deflate the bladder without returning the inflation device 46 to the vessel 12.

Figure 6:
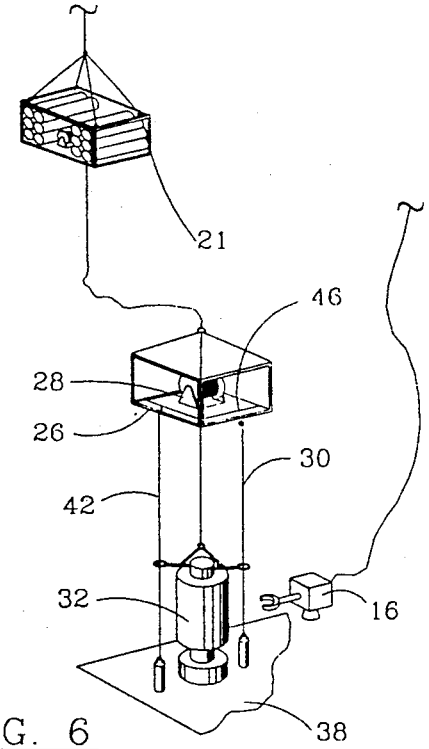
FIG. 6 illustrates the payload connected to the subsea assembly and the payload package ballast to de-couple the package from the ROV garage and thus the vessel.

FIG. 6 illustrates the package 26 decoupled from the vessel 12, and the winch 28 activated to lower the cable 30 and thus the payload 32 attached thereto unto the installation site 36 of the assembly 38. This landing operation is substantially simplified since the payload 32 is supported by the package 26, which has been decoupled from the vessel. Moreover, the guide wires 42 may be used to guide the downward movement of the payload with respect to the installation site on the subsea assembly. If desired, for example, conventional eye bolts may be secured to and extend from the payload, with the guide wires 42 passing through the eyelets in the bolts to further assist in guiding the payload downward to the installation site. FIG. 6 also depicts the ROV 16 positioned closely adjacent the installation site. Those skilled in the art appreciate that the ROV will typically be provided with conventional monitoring equipment, such as a television camera, so that operators on the vessel 36 may observe the movement of the payload and use the ROV to correct any problems which may arise. Once landed, the payload 32 may be secured to the subsea assembly 36 by the ROV 16 in a conventional manner.

Figure 7:
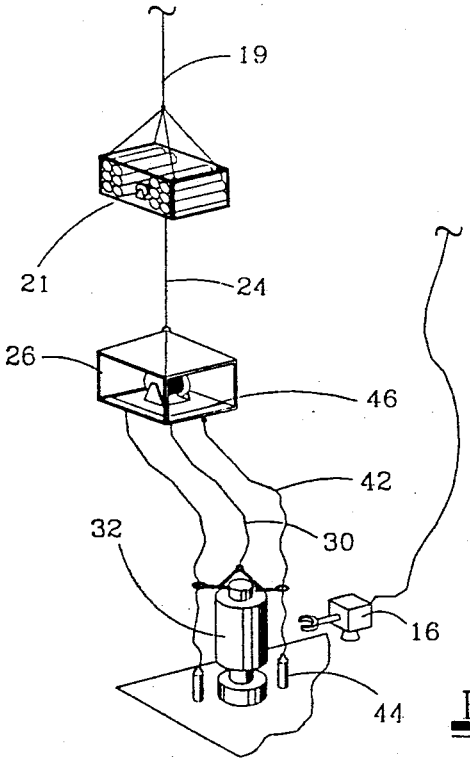
FIG. 7 illustrates the payload package deballast and recoupled to the ROV garage.
Figure 8:
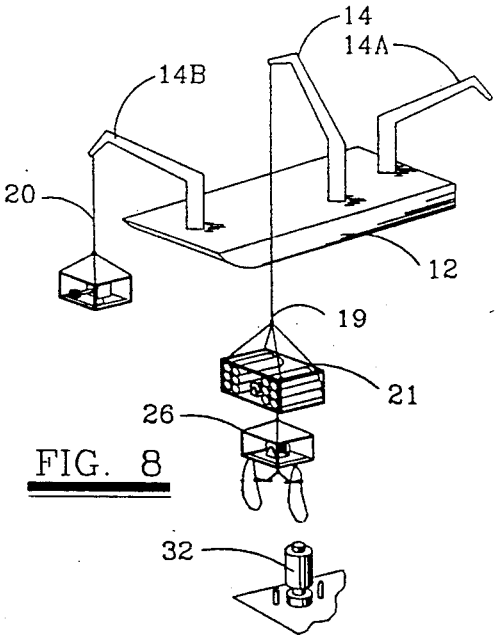
FIG. 8 illustrates the guide wires removed from the subsea installation site, and the retrieval of the garaged ROV and the payload package to the surface vessel.

Once the payload has been secured to the subsea assembly, the ROV may be used to disconnect the payload 32 from the cable 30, and the winch 28 activated to retrieve the cable 30. The package 26 may then be recoupled to the garage 18 and the vessel 12, and simultaneously decoupled from the subsea assembly 38 by deactivating the floatation device 46, thereby causing the package 26 to again become heavier than water so that the cable 24 becomes taunt and the guide cable 42 are slack, as shown in FIG. 7. The cables 42 may then be removed from the connectors 44 by the ROV 16, and the free ends of the cables then connected back to the package 26 in a loop. After proper conventional checks and verifications of the installation and perhaps the operation of the payload 32, the ROV 16 may be returned to garage 18, and winch 22 activated to raise the package 26 to a position closely adjacent the garage, at which time the garage, ROV, and package may be returned to the vessel 12 by cable 20, as shown in FIG. 8.

Various modifications of the previosly described technique are possible within the scope of the present invention. As one example, if the vessel 12 is provided with a crane 14 of sufficient height, the garage (and the ROV housed therein), the package 26 and the payload 32 may be lowered from the vessel into the water as an assembly, rather than attach the package and payload to the garage in the manner previously described. It should be understood that the approximate dimensions provided for positioning the garage, the package, and the payload prior to decoupling the package and payload from the vessel are exemplary, and the desired distance will depend upon the capabilities of the operator and various factors affecting that particular job.

Figure 9:
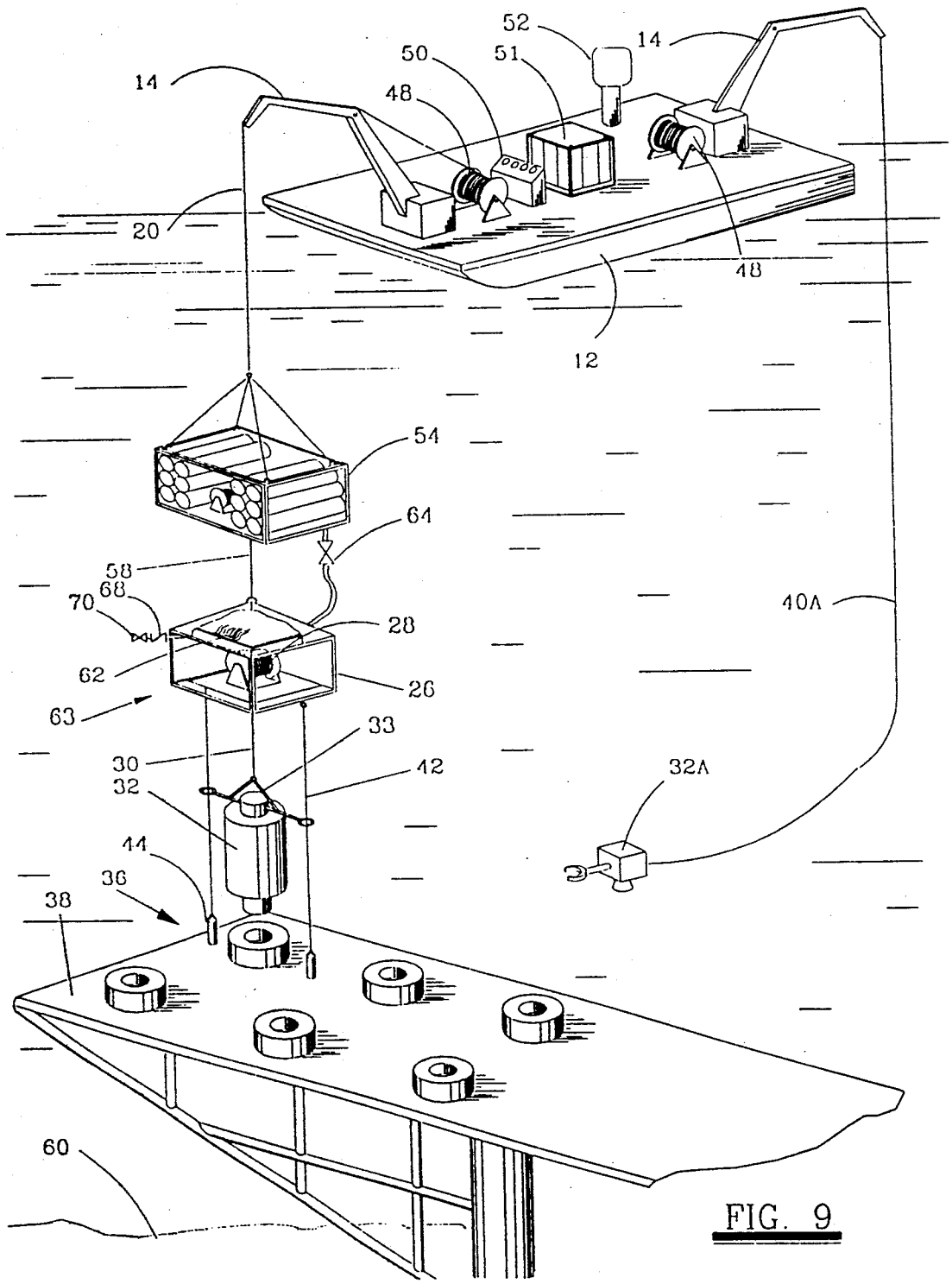
FIG. 9 illustrates an alternative embodiment of the present invention, wherein an all electric ROVs is used in conjunction with a universal payload deployment unit.

FIG. 9 illustrates another embodiment of the present invention, wherein the ROV utilized is a rather lightweight "all electric" ROV 32A which does not require a garage. In this case, the ROV is continually in contact with the vessel 12 by the much longer tether line 40A. The vessel 12 is shown with a powered winch 48 for winding and unwinding cable 20, which supports the package 26 and payload 32. Also depicted on the vessel 12 are a plurality of control panels 50 for operating the subsea components in a conventional manner, a hydraulic power unit 51, and a television monitor 52 for visually observing information from the camera in the ROV. Since a ROV garage is not utilized, an upper payload deployment device 54 may be used, including a powered winch 56 for controlling the length of cable 58 between device 54 and the package 26. Alternatively, the lower end of cable 20 may be connected directly to package 26. As still a further modification, the package 26 may be eliminated, and the payload 32 lowered from a winch on the upper pay load deployment device 54, in which case the device 54 rather than package 26 may include the guide cables connected at their upper end thereto. FIG. 9 illustrates in somewhat greater detail a conventional subsea assembly 38 affixed to the ocean floor 60. The package 32 is to be landed at installation site 36, and a plurality of connection devices 44 have previously been fixed to the installation site to facilitate attachment of the cables, 42 as explained previously.

FIG. 9 also illustrates further details with respect to a suitable floatation device 63 mounted on or attached to the payload package 26, or preferably the combination of package 26 and device 54. Floatation device 63 includes an expandable volume chamber or bladder 62 within package 26 which, when filled with a suitable gas, such as air or nitrogen, causes package 26 to become positively buoyant. Compressed gas storage tanks 66 preferably housed in device 54 supply the gas to bladder 62 via line 63. The valve 64 may be open to allow to air to pass from tank 66 into the chamber 62. A plurality of compressed gas tanks may be used, and the ROV employed to open a valve 64 associated with each tank to inflate chamber 62 to the extent desired. To deflate the chamber 62, the ROV may open valve 70, thereby allowing the gas to escape to the subsea environment. The check valve 68 prevents water from entering the chamber 62.

The techniques and apparatus described herein are well suited to safety and reliably land a payload at a subsea installation site with a payload being lowered vertically onto the installation site, as explained above. It is also within the scope of the invention that the payload may be mounted to the installation site such that it extends horizontally from or is cantilevered from the subsea assembly. In this case, the guide wires may be connected to the subsea assembly at a location slightly below but closely adjacent the installation site. The payload would then be lowered to the desired depth of the installation site using the guide wires and ROV. Once properly positioned, the ROV would then connect the payload, the guide wires may then be disconnected, and the package 26 then re-coupled to the vessel by de-ballasting the floatation device.

It should thus be understood that the system of the present invention is able to obtain the advantages previously discussed, and provides a relatively inexpensive technique for landing and securing a subsea payload to oil production facility or similar device. Although specific components and procedures have been described herein for purposes of explanation, it should be understood that various changes and modifications may be made to the embodiments discussed herein without departing from the spirit and scope of the invention.

What is claimed is:

1. A method of landing and securing a payload to a subsea hydrocarbon recovery assembly utilizing a surface vessel, a vessel winch, a vessel cable wound about the vessel winch, a subsea ROV, and a control panel for operating the ROV, the method comprising:

providing a submersible payload package including a powered package winch and a package cable wound about the winch;

providing a floatation device attached to the payload package;

suspending the payload from the package cable;

lowering the package and the payload toward the subsea hydrocarbon recovery assembly via the vessel winch and vessel cable;

connecting one or more guide cables extending from the package to the subsea hydrocarbon recovery assembly;

thereafter activating the floatation device such that the package becomes positively buoyant, thereby making the guide cables taunt and relaxing the vessel cable to de-couple the package and the payload from the surface vessel;

thereafter activating the powered package winch to lower the payload onto the subsea hydrocarbon recovery assembly with the guide cables remaining taunt;

thereafter manipulating the ROV to connect the payload to the subsea hydrocarbon recovery assembly;

thereafter deactivating the floatation device such that the package becomes negatively buoyant, thereby making the vessel cable taunt and the guide cables relaxed to re-couple the package to the surface vessel; and thereafter activating the vessel winch to retrieve the package to the surface vessel.

2. The method as defined in claim 1, further comprising:

housing the ROV within a garage including a garage winch and a garage cable extending therefrom;

suspending the garage and the ROV from the vessel cable; and suspending the payload package and payload from another vessel cable.

3. The method as defined in claim 2 further and comprising:

connecting the ROV to the garage with a tether line.

4. The method as defined claim 1, further comprising:

guiding the payload toward the subsea installation site by the guide cables as the payload is lowered onto the subsea hydrocarbon recovery assembly.

5. The method as defined in claim 4, further comprising:

providing one or more guide members extending outward from the payload; and inserting the one or more guide cables within corresponding ones of the guide members to guide the payload.

6. The method as defined in claim 1, wherein the step of providing the floatation device comprises:

providing an inflation member attached to the payload package;

providing a subsea compressed gas tank housing a compressed gas; and selectively inputting gas from the tank to the inflation member to inflate the member and positively ballast the payload package.

7. The method as defined in claim 6, further comprising;

providing a release valve to release gas from the inflation member; and opening the release valve to de-ballast the payload package.

8. The method as defined in claim 7, further comprising:

inputting additional gas to re-inflate the inflation device after releasing gas from the inflation device to re-ballast the payload package.

9. The method as defined in claim 1 further comprising:

monitoring payload positions during landing of the payload on the subsea hydrocarbon recovery assembly with the ROV.

10. The method as defined in claim 1, further comprising:

housing the ROV within a garage including a garage winch and a cable extending therefrom; and suspending the garage, the ROV, the payload package, and the payload from the vessel cable.

11. A method of landing and securing a payload to a subsea assembly, utilizing a surface vessel and a vessel cable extending from the surface vessel, the method comprising:

providing a submersible payload package including a package cable extending from the payload package;

providing a floatation device attached to the payload package;

suspending the payload from the package cable;

lowering the package and the payload subsea toward the assembly via the vessel cable;

connecting a guide cable extending from the package to the assembly;

thereafter activating the floatation device such that the package becomes positively buoyant, thereby making the guide cable taunt and relaxing the vessel cable to de-couple the package from the surface vessel;

thereafter lowering the payload onto the subsea assembly via the payload cable, with the guide cable remaining taunt;

thereafter connecting the payload to the assembly;

thereafter de-activating the floatation device such that the package is not positively buoyant, thereby making the vessel taunt and the guide cable relaxed to re-couple the package to the surface vessel; and thereafter retrieving the package to the surface vessel.

12. The method as defined in claim 11, further comprising;

guiding the payload toward the assembly by lifting the guide cable as the payload is lowered onto the assembly.

13. The method as defined in claim 11, wherein the step of providing the floatation comprises:

providing an inflation member attached to the payload package;

providing a subsea compressed gas tank housing a compressed gas; and selectively inputting gas from the tank to the inflation member to inflate the member and positively ballast the payload package.

14. The method as defined in claim 13, further comprising:

providing a release valve to release gas from the inflation member; and opening the release valve to de-ballast the payload package.

15. The method as defined in claim 11, further comprising:

providing a subsea ROV; and monitoring the payload position during landing with the ROV.

16. Apparatus for landing and securing a payload to a subsea assembly utilizing a surface vessel and a vessel cable extending from the surface vessel, the apparatus comprising:

a submersible payload package suspended from the vessel cable;

one or more guide cables extending from the payload package for securing to the subsea assembly;

a submersible floatation device connected to the payload package selectively activatable to render the payload package positively buoyant and selectively de-activated so that the payload package is not buoyant;

a powered vessel winch on the vessel for controllably lowering and raising the submersible payload package; and a powered package winch connected to the payload package for selectively lowering the payload with respect to the payload package.

17. The apparatus as defined in claim 16, further comprising;

a submersible ROV for monitoring the position of the payload during landing; and a control panel on the surface vessel for operating the ROV.

18. The apparatus as defined in claim 16, further comprising;

guide means extending from the payload for receiving a respective one of the one or more guide cables and thereby guiding the payload onto the assembly.

19. The method as defined in claim 16, wherein the floatation device comprises:

an inflation member attached to the payload package; and a submersible compressible gas tank for housing a gas to selectively inflate the inflation member.

20. The apparatus as defined in claim 19, further comprising:

a release valve for selectively releasing gas from the inflation member.

21. The apparatus as defined in claim 20, further comprising:

a check valve for prohibiting water from entering the inflation device.

* * * * *